US010364641B2

(12) United States Patent
Carmody et al.

(10) Patent No.: US 10,364,641 B2
(45) **Date of Patent: *Jul. 30, 2019**

(54) OPEN-HOLE MECHANICAL PACKER WITH EXTERNAL FEED THROUGH AND RACKED PACKING SYSTEM

(71) Applicant: Baker Hughes, a GE company, LLC, Houston, TX (US)

(72) Inventors: Michael Carmody, Houston, TX (US); Clifford T Frazee, Katy, TX (US); Matthew Krueger, Cypress, TX (US); Frank Maenza, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/722,160

(22) Filed: Oct. 2, 2017

(65) Prior Publication Data

US 2019/0100978 A1 Apr. 4, 2019

(51) Int. Cl.

| | |
|---|---|
| ***E21B 33/128*** | (2006.01) |
| ***E21B 23/06*** | (2006.01) |
| ***E21B 33/12*** | (2006.01) |
| ***E21B 17/02*** | (2006.01) |

(52) U.S. Cl.

CPC ..... *E21B 33/1285* (2013.01); *E21B 17/023* (2013.01); *E21B 23/06* (2013.01); *E21B 33/1208* (2013.01)

(58) Field of Classification Search

CPC ..... E21B 33/128; E21B 33/1208
USPC ..... 166/187
See application file for complete search history.

(56) References Cited

U.S. PATENT DOCUMENTS

| | | | | |
|---|---|---|---|---|
| 2,253,092 | A | 8/1941 | Albert | |
| 3,899,631 | A | 8/1975 | Clark | |
| 6,173,788 | B1 | 1/2001 | Lembcke et al. | |
| 7,431,082 | B2 | 10/2008 | Holt et al. | |
| 7,611,339 | B2 | 11/2009 | Tetzlaff et al. | |
| 7,762,322 | B2 | 7/2010 | Andersen et al. | |
| 7,836,960 | B2 | 11/2010 | Patel et al. | |
| 8,083,000 | B2 | 12/2011 | Nutley et al. | |
| 8,215,394 | B2 | 7/2012 | Cascario et al. | |
| 8,459,367 | B2 | 6/2013 | Nutley et al. | |
| 2014/0014373 | A1* | 1/2014 | Richards | E21B 17/026 166/385 |
| 2015/0226023 | A1* | 8/2015 | Scruggs | E21B 47/12 166/250.1 |

OTHER PUBLICATIONS

Easywell; Swellpacker Cable System, Achieve Complete Zonal Isolation in Intelligent Wells and Reduce Completion Costs Oct. 2007.

* cited by examiner

*Primary Examiner* — Taras P Bemko
(74) *Attorney, Agent, or Firm* — Parsons Behle & Latimer

(57) ABSTRACT

A mechanically-set packer system for use in a wellbore may include a packer assembly. The packer assembly may include a first ring and a second ring. The packer assembly may also include a packing element positioned between the first ring and the second ring. The packer system may include a mandrel having an interior and an exterior. The packer assembly may be configured to slide onto the exterior of the mandrel. The packer system may further include a line configured to run between the exterior of the mandrel and an interior of the packing element.

17 Claims, 5 Drawing Sheets

OPEN-HOLE MECHANICAL PACKER WITH EXTERNAL FEED THROUGH AND RACKED PACKING SYSTEM

CROSS-REFERENCE TO RELATED APPLICATIONS

This application is related to U.S. patent application Ser. No. 15/722,271 filed on Oct. 2, 2017, and entitled "Open-Hole Mechanical Packer with External Feed Through Run Underneath Packing System," and U.S. patent application Ser. No. 15/722,197 filed on Oct. 2, 2017, and entitled "Locking Keyed Components for Downhole Tools," the contents of each of which are hereby incorporated by reference in their entirety.

FIELD OF THE DISCLOSURE

The disclosure is related to the field of mechanically-set packers and more particularly to mechanically-set packers with external feed through and racked packer assemblies.

BACKGROUND

In open-hole wellbore operations, a packer assembly system may sometimes be used to create a seal between an uphole portion of a wellbore and a downhole portion of the wellbore in order to enable operations to be performed by one or more tools on a string within the downhole portion. Mechanically-set packer assembly systems may rely on non-swellable materials that are expanded by mechanical means, as opposed to swelling means, to form a seal with a wall of the wellbore. Any interruptions between a packing element, or a sealing element, of the packer assembly system and the wellbore wall may prevent proper sealing and may adversely affect operations in the wellbore.

A typical packer assembly system may not provide accommodations for communication lines and/or control lines to be inserted within the packer system. If accommodations are provided, in a typical packer assembly, the line may be run either through the packing element, through an exterior of the packer assembly system, or through a drilled hole in the mandrel, which may result in the packer assembly not sealing completely when set within a wellbore. Some packer assemblies may rely on swellable materials to try to reduce this potential problem. However, in a mechanically set packer assembly, swellable materials may not be compatible with a packing or sealing element. Further, after assembly a typical packer assembly system may not enable a line to be subsequently inserted into an interior of the packer assembly. Packer assemblies that provide a line through either the packing element, an exterior of the packer assembly, or through the mandrel typically require splicing the communication line and/or control line above and below the packer assembly. Splices in a communication line and/or a control line may significantly degrade signal quality and may, therefore, adversely affect operations within the wellbore. Further, splices in the line may present a weak point, which may affect the integrity of the seal provided by the packer. Other disadvantages may exist.

SUMMARY

The present disclosure is directed to a packer system for use in a wellbore. The packer system may include a racked, or preassembled, packer assembly that can be slid onto mandrel. A continuous line, such as a communication and/or control line, may be inserted into an interior of the packer assembly such that the line does not require splicing to connect a portion of the line above the packer assembly to a portion of the line below the packer assembly.

In an embodiment, a mechanically-set packer system includes a packer assembly. The packer assembly includes a first ring and a second ring. The packer assembly further includes a packing element positioned between the first ring and the second ring. The system includes a mandrel having an interior and an exterior. The packer assembly is configured to slide onto the exterior of the mandrel. The system further includes a line configured to run between the exterior of the mandrel and an interior of the packing element.

In some embodiments, the first ring is a first inner groove ring and the second ring is a second inner groove ring. In some embodiments, the packer assembly further includes a first outer grooved ring and a second outer grooved ring. The first inner groove ring and the second inner groove ring may be positioned between the first outer grooved ring and the second outer grooved ring. In some embodiments, the packer assembly further includes a first keyed inner wedge ring and a second keyed inner wedge ring. The first outer grooved ring and the second outer grooved ring may be positioned between the first keyed inner wedge ring and the second keyed inner wedge ring. In some embodiments, the first keyed inner wedge ring and the second keyed inner wedge ring each include a keyed opening that enables the packer assembly to slide off the mandrel. In some embodiments, the packer assembly further includes a first wedge C-ring and a second wedge C-ring. The first keyed inner wedge ring and the second keyed inner wedge ring may be positioned between the first wedge C-ring and a second wedge C-ring. In some embodiments, the packer assembly further includes a keyed gauge ring. The keyed gauge ring may include a keyed opening that enables the packer assembly to slide off the mandrel. In some embodiments, the packer assembly may be assembled at a well site.

In some embodiments, the system further includes a longitudinal recess in the exterior of the mandrel, the longitudinal recess configured to receive the line therein. In some embodiments, the system includes a cover positioned over at least a portion of the line positioned between the exterior of the mandrel and the interior of the packing element. The cover may include a metallic material, an elastomeric material, a thermoplastic material, or a combination thereof. In some embodiments, the packer assembly is configured to be mechanically set within an open-hole wellbore. In some embodiments, the packing element includes a cut to enable the feed line to be installed within the inner diameter of the packing element sub-assembly after the packing element sub-assembly is assembled. In some embodiments, the line is a pneumatic line, an electrical line, or an optical line. In some embodiments, the system includes a housing having an exterior and an interior, the interior of the housing positioned on a portion of the exterior of the mandrel. The line may pass through a groove within the housing from the interior of the housing to the exterior of the housing. In some embodiments, the mandrel includes a first end and a second end. The line may include no splices between the first and the second end.

In an embodiment, a method includes assembling a packer assembly that includes a first ring, a second ring, and a packing element positioned between the first ring and the second ring. The method further includes installing a line within an inner diameter of the packer assembly. The method also includes sliding the packer assembly onto an exterior of a mandrel, where the feed line is positioned between the mandrel and the packing element.

In some embodiments, the method includes mechanically setting the packer assembly within an open-hole wellbore. Setting the packing element may form a seal with the feed line, the mandrel, and a wall of the open-hole wellbore. In some embodiments, mechanically setting the packing element sub-assembly comprises applying weight-set compression, hydraulic-set compression, or hydrostatic-set compression to the packing element.

In an embodiment, a packing element sub-assembly system includes at least one wedge C-ring. The system further includes at least one keyed wedge ring. The system also includes a packing element having an interior and an exterior and configured to receive a mandrel and a feedline within the interior. The feedline is positioned between an exterior of the mandrel and the interior of the packing element. In some embodiments, the system includes at least one keyed gauge ring, at least one outer grooved C-ring, and at least one inner grooved C-ring.

Figure 1:
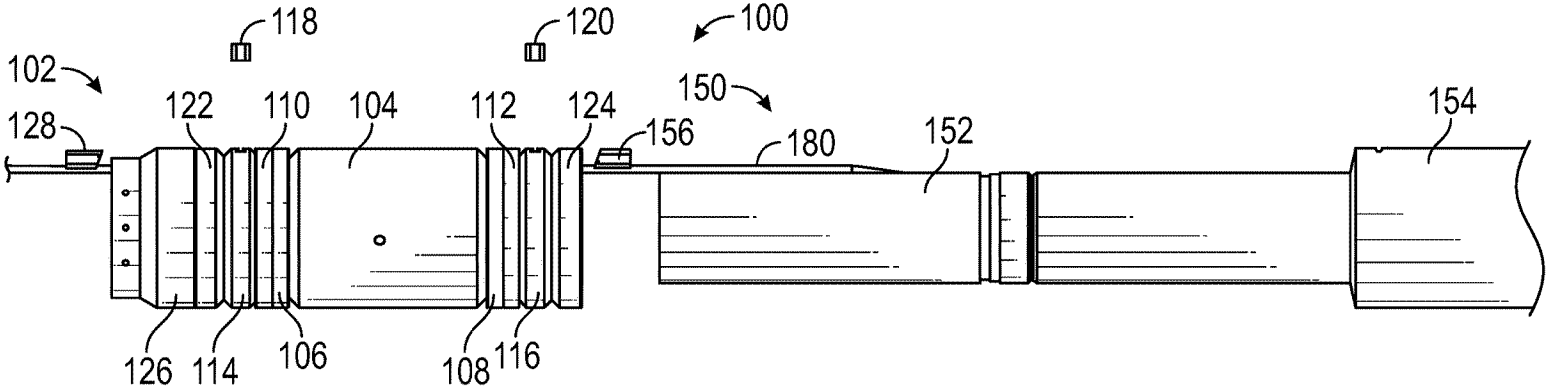
FIG. 1 is a schematic drawing depicting a side view of an embodiment of a mechanically-set packer system for use in a wellbore.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure.

DETAILED DESCRIPTION

Referring to FIG. 1, a side view of an embodiment of a mechanically-set packer system 100 for use in a wellbore is depicted. The system 100 may include a packer sub assembly 102, hereinafter referred to as packer assembly 102, and a base assembly 150. The packer assembly 102 may be used to create a seal between the system 100 and a wellbore. As discussed in the above related patent applications entitled "Open-Hole Mechanical Packer with External Feed Through Run Underneath Packing System" and "Locking Keyed Components for Downhole Tools," it may be beneficial to run a continuous line, such as line 180 shown in FIG. 1, down a work or tubing string that does not require splices to traverse the string. The line 180 may provide communication with a downhole location, control of a downhole device, or both as would be appreciated by one of ordinary skill in the art having the benefit of this disclosure. As the line 180 travels along the string it may need to bypass the seal made by the packer assembly 102.

In FIG. 1, the packer assembly 102 is depicted before being slid onto the base assembly 150. The packer assembly 102 may be preassembled or may be racked (i.e., assembled) on a rig floor before being installed onto the base assembly 150 and run into the wellbore. For example, the packer assembly 102 may be assembled on-site at a well site to await installation within the system 100. Once installed, the packer assembly 102 may be configured to be mechanically set within an open-hole wellbore.

The packer assembly 102 may include a packing element 104. The packing element 104 may be suitable for mechanically-set packing. As such, the packing element 104 may be formed from a non-swellable material. The non-swellable material may include a metallic material, an elastomeric material, a thermoplastic material, or a combination thereof. The process of mechanically setting the packing element 104 is further described herein.

The packer assembly 102 may further include multiple rings. For example, the packer assembly 102 may include a first inner grooved C-ring 106 and a second inner grooved C-ring 108. The packer assembly 102 may also include a first outer grooved C-ring 110 and a second outer grooved C-ring 112. The first inner grooved C-ring 106 and the first outer grooved C-ring 110 may be positioned on a first or uphole side of the packing element 104 while the second inner grooved C-ring 108 and the second outer grooved C-ring 112 may be positioned on a second or downhole side of the packing element 104.

The packer assembly 102 may include a first keyed inner wedge ring 114 on an uphole side of the packing element 104 and a second keyed inner wedge ring 116 on a downhole side of the packing element 104. The inner wedge rings 114, 116 may have a circumferential gap defined therein to enable the insertion of the line 180 into an interior of the wedge rings 114, 116. A first inner wedge ring key 118 may correspond to a gap in the first keyed inner wedge ring 114 and may be inserted into the gap after the line 180 has been installed to complete the first keyed inner wedge ring 114 and to provide structural support thereto. Likewise, a second inner wedge ring key 120 may correspond to a gap in the second keyed inner wedge ring 116 and may be inserted into the gap to complete the second keyed inner wedge ring 116. This configuration enables installation of the line 180 into the packer assembly 102 after the packer assembly 102 has been assembled, but before the packer assembly 102 is slid onto the mandrel 152, as discussed herein.

The packer assembly 102 may further include a first wedge C-ring 122 positioned uphole to the packing element 104 and a second wedge C-ring 124 positioned downhole to the packing element 104. During installation and setting, each of the uphole rings 106, 110, 114, 122 may be compressed and may, thereby, engage each other to expand the packing element 104 from an uphole side. Likewise, each of the downhole rings 108, 112, 116, 124 may be compressed and may engage each other to expand the packing element 104 from a downhole side. Thus, rather than swelling, the packing element 104 may be expanded mechanically. Expansion of the packing element 104 is further described herein.

The packer assembly may also include a keyed gauge ring 126. The keyed gauge ring 126 may engage the first wedge C-ring 122 uphole from the packing element 104. The keyed gauge ring 126 may also include a gap defined therein to enable installation of the line 180 within the keyed gauge ring 126 after the packer assembly 102 is assembled, but before the packer assembly 102 is slid onto the mandrel 152, as discussed herein. A first gauge ring key 128 may correspond to a gap in the keyed gauge ring 126 and may be inserted into the gap to complete the keyed gauge ring 126 and provide structural support thereto.

The number, shape, size, and/or configurations of the ring elements is shown for illustrative purposes only and may be varied depending on the application as would be appreciated by one of ordinary skill in the art having the benefit of this disclosure. As used herein, a "first ring" comprises any element configured to be positioned around the mandrel 152 on a first side of the packer element 104 and a "second ring" comprises any element configured to be positioned around the mandrel 152 on a second side of the packer element 104.

The base assembly 150 may include a mandrel 152 and a housing 154. The housing 154 may also be referred to as a push wedge ring. The mandrel 152 and the housing 154 may be coupled to additional string elements (not shown) which may in turn attach to a tool for use within the wellbore. A second gauge ring key 156 may correspond to the housing 154 and may be inserted into a gap or groove defined therein that enables the line 180 to pass from an interior of the housing 154 to an exterior of the housing 154 as described herein.

Thus, the line 180 may pass within an interior of the packer assembly 102 and over an exterior of the mandrel 152. Further, as described herein, during installation, the line 180 may be installed within the interior of the packer assembly 102 after the packer assembly 102 is assembled and before the packer assembly is slid onto the base assembly 150. The line may be continuous, having no splices at least along the length of the mandrel 152. In some embodiments, the line is continuous, having no splices from a surface of the wellbore to a tool attached to the end of the mandrel 152 or to a tool attached to a string attached to the end of the packer system 100. The line may be a pneumatic line, an electrical line, an optical line, or another type of line capable of control or communication.

Figure 2:
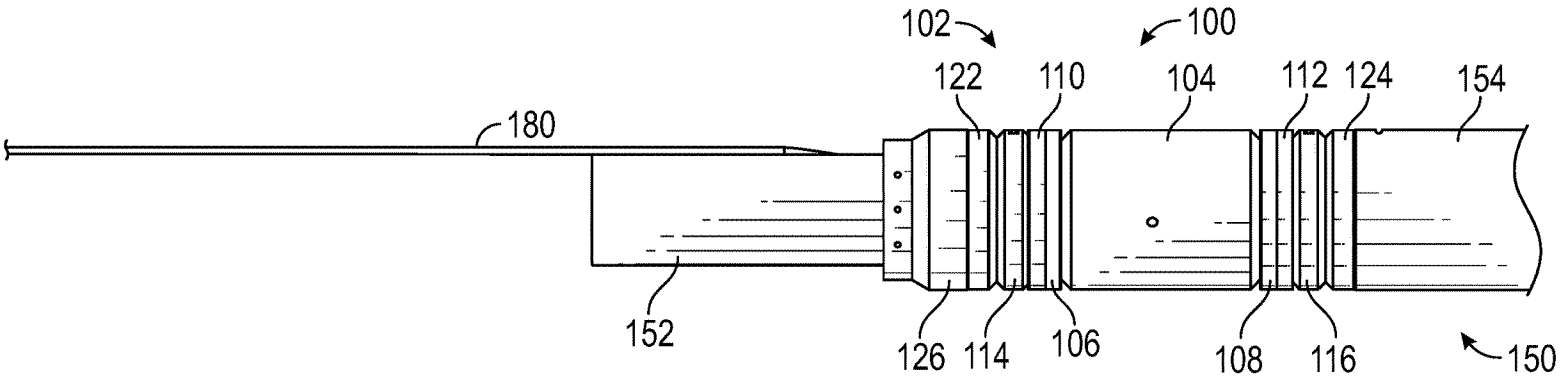
FIG. 2 is a schematic drawing depicting a side view of an embodiment of a mechanically-set packer system for use in a wellbore.

Referring to FIG. 2, a side view of an embodiment of a mechanically-set packer system 100 for use in a wellbore is depicted. In FIG. 2, the packer assembly 102 has been slid onto the mandrel 152 of the base assembly 150. In the process, the packer assembly 102 is shifted while the line 180 remains in its position. The keys 118, 120, 128, 156 have been inserted in their respecting rings 114, 116, 126, 154, thereby locking the packer assembly 102 in place on the mandrel 152.

An advantage of the system 100 is that by enabling the line 180 to be installed within an interior of the packer assembly 102 after the packer assembly 102 has been assembled and before the packer assembly 102 is slid onto the base assembly 150, a continuous line 180 may be used instead of splicing the line 180. This is in contrast to typical packer systems in which communication and/or control lines are spliced on each end of the packer system to a pre-constructed line built within the packer systems. Other advantages may exist.

Figure 3:
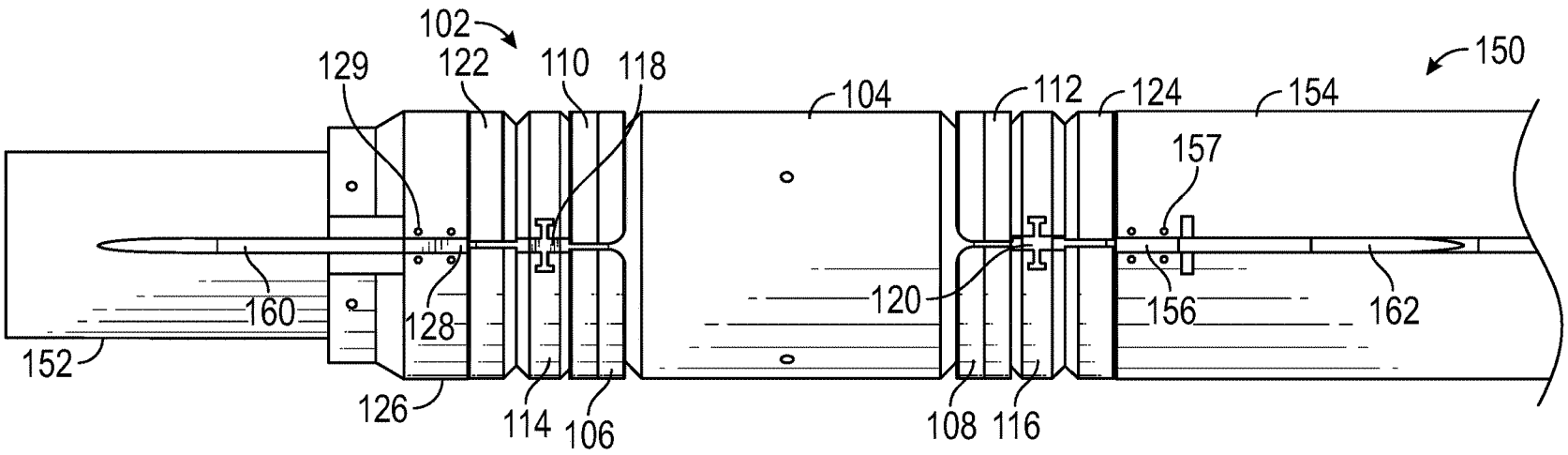
FIG. 3 is a schematic drawing depicting a top view of an embodiment of a mechanically-set packer system for use in a wellbore.

Referring to FIG. 3, a top view of an embodiment of a mechanically-set packer system 100 for use in a wellbore is depicted. While FIG. 3 does not depict the line 180 for clarity, various features are depicted that enable the line 180 to pass within an interior of the packer assembly 102 and ultimately to an exterior of the base assembly 150 are shown.

As seen in FIG. 3, the mandrel 152 may include a longitudinal recess 160 defined in the exterior thereof. The longitudinal recess 160 may be configured to receive the line 180 therein, which is not shown in FIG. 3 for clarity. The longitudinal recess 160 may retain the line 180 to prevent axial slippage and to prevent the line from interfering with the operation of the packer assembly 102. Although FIG. 3 depicts the longitudinal recess 160 as running along a limited portion of the length of the mandrel 152, in some embodiments, the longitudinal recess 160 may run along the full length of the mandrel 152.

FIG. 3 also depicts that the keys 118, 120, 128, 156 have been inserted into their respective keyed rings 114, 116, 126, 154. Before the keys 118, 120, 128, 156 are inserted, the keyed rings 114, 116, 126, 154 may have a gap that enables the line 180 to be pass from an exterior to an interior of the keyed rings 114, 116, 126, 154. The C-rings 106, 108, 110, 112, 122, 124 may also include gaps that enable the insertion of the line 180. These rings, however, may not be keyed to allow for radial expansion. Instead, the rings may include a gap that permits both the radial expansion of the ring as well as removal of the ring component from off the line 180 as discussed in the above referenced related applications.

The gaps in each of the keyed rings 114, 116, 126, 154, and in each of the C-rings 106, 108, 110, 112, 122, 124 may enable individual rings to be removed from their position on the mandrel 152 without affecting the remaining rings, such as for replacement or upgrading purposes. The line 180 may likewise be inserted or removed from rings individually. Other advantages of the gaps may exist.

In some embodiments, one or more fasteners may be used to retain the keys 118, 120, 128, 156. For example, FIG. 3 depicts one or more fasteners 129 locking the key 128 into place. Likewise, one or more fasteners 157 may lock the key 156 into place. Alternatively, other retention mechanisms may be used to lock the keys 118, 120, 128, 156 into place, such as interference fits, glue, welding, other attachment mechanism, or any combinations thereof.

The housing 154 may include a groove 162 defined therein. The groove 162 may provide a pathway for the line 180 to pass from an interior of the housing 154 to an exterior of the housing 154. The key 156 may close off the groove 162, thereby locking in the line 180 and providing structural support for the housing 154.

Although not depicted in FIG. 3, in some embodiments, the packing element 104 may include a cut to enable the line 180 to be installed within an interior of the packing element 104. The cut may be a longitudinal cut across the length of the packing element 104 or the cut may have other shapes, such as a spiral shape or other patterned shape. In other embodiments, the packing element 104 may be cut by a technician assembling the packer assembly 104. Yet in other embodiments, the packing element 104 may be threaded onto the line 180 before assembly.

Figure 4:
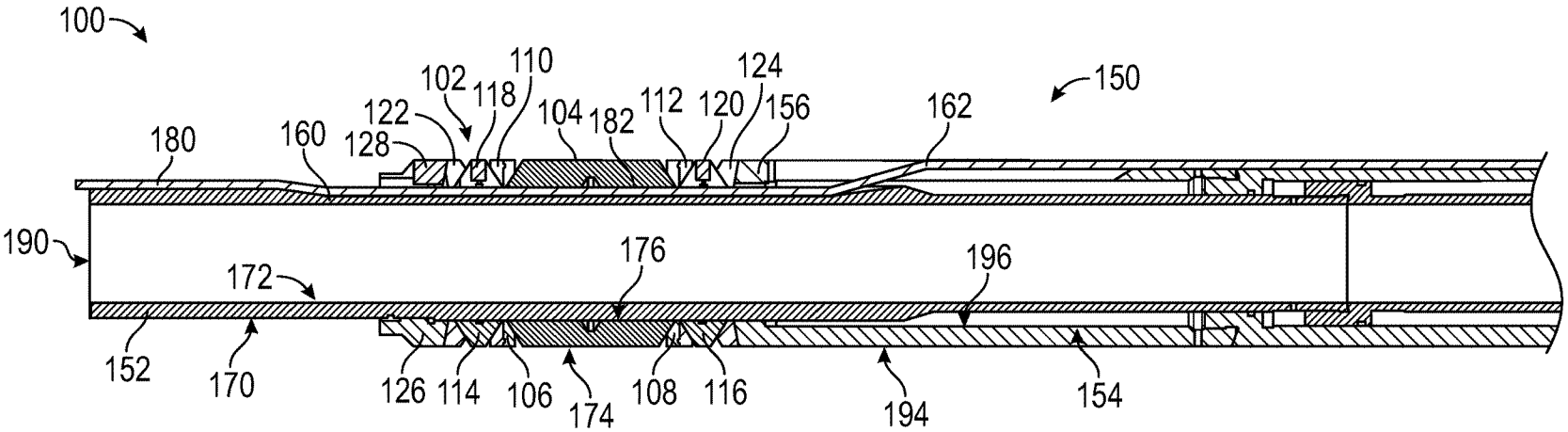
FIGS. 4 and 5 are schematic drawings depicting sectional views of an embodiment of a mechanically-set packer system for use in a wellbore.
Figure 5:
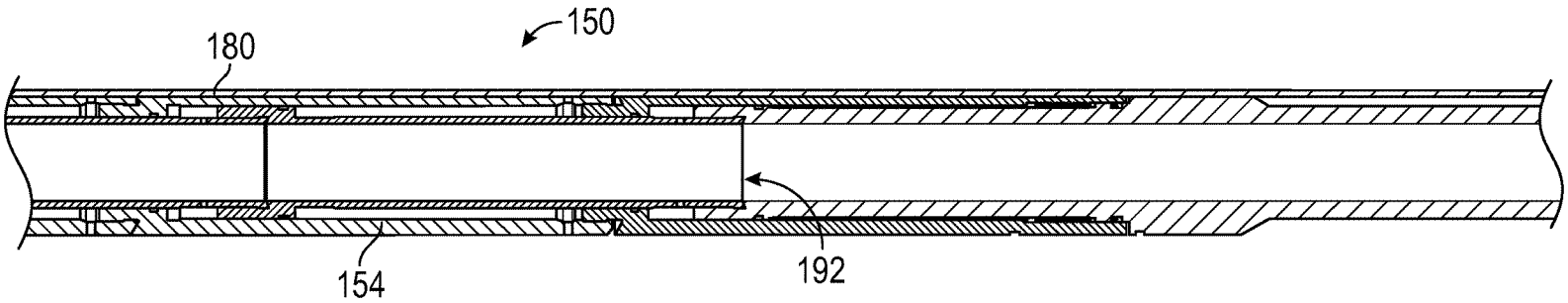

Referring to FIGS. 4 and 5, sectional views of an embodiment of a mechanically-set packer system 100 for use in a wellbore are depicted. As shown in FIG. 4, the mandrel 152 may include an exterior 170 and an interior 172. The line 180 may run along the exterior 170 of the mandrel 152. The packing element 104 may also include an exterior 174 and an interior 176. The line 180 may be positioned between the exterior 170 of the mandrel 152 and the interior 176 of the packing element 104. The line may further be positioned between an interior of each of the rings 106, 108, 110, 112, 114, 116, 122, 124, 126 and the mandrel 152. The keys 118, 120, 128, 156 may cover the line 180 retaining it in its position within the interior of the packing assembly 102.

A cover 182 may be positioned over the line 180 between the packing element 104 and the mandrel 152. The cover 182 may include a metallic material, an elastomeric material, a thermoplastic material, or a combination thereof. The cover 182 may assist with forming a seal with the packing element 104 against the line 180 when the packer assembly 102 is expanded and set.

The housing 154 may include an exterior 194 and an interior 196. As depicted, the groove 162 may pass through the housing 154 providing a pathway for the line 180. The line 180 may pass through the groove 162 from the interior 196 of the housing 154 to the exterior 194 of the housing 154. From there, the line 180 may pass to a tool (not shown) attached to the housing 154.

The mandrel 152 may include a first end 190, shown in FIG. 4, and a second end 192, shown in FIG. 5. The line 180 may pass from the first end 190 to the second end 192 without any splices. An advantage of passing the length of the mandrel 152 without any splices is that better communication through the line 180 may be enabled without interruption during the installation of the packer assembly 102. Other advantages may exist.

Figure 6:
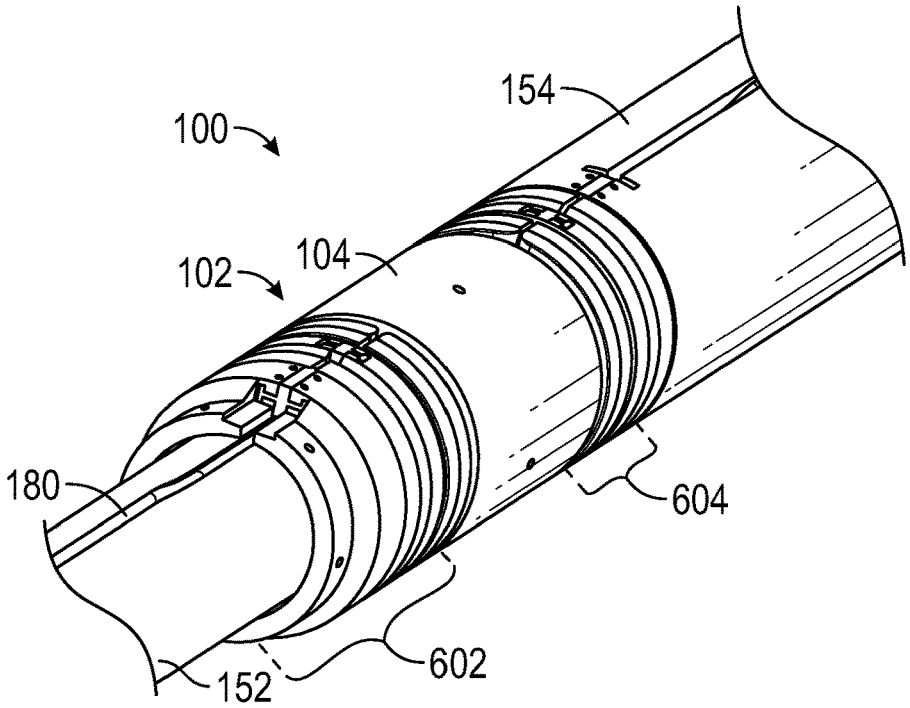
FIG. 6 is a schematic drawing depicting an isometric view of an embodiment of a mechanically-set packer system for use in a wellbore is depicted.

Referring to FIG. 6, an isometric view of an embodiment of a mechanically-set packer system 100 for use in a wellbore is depicted. In FIG. 6, the packer assembly 102 is shown as being unset. FIG. 6 depicts a first set of rings 602 and a second set of rings 604. The first set of rings 602 may include the first inner grooved C-ring 106, the first outer grooved C-ring 110, the first keyed inner wedge ring 114, the first wedge C-ring 122, and the keyed gauge ring 126. The second set of rings 604 may include the second inner grooved C-ring 108, the second outer grooved C-ring 112, the second keyed inner wedge ring 116, and the second wedge C-ring 124.

Figure 7:
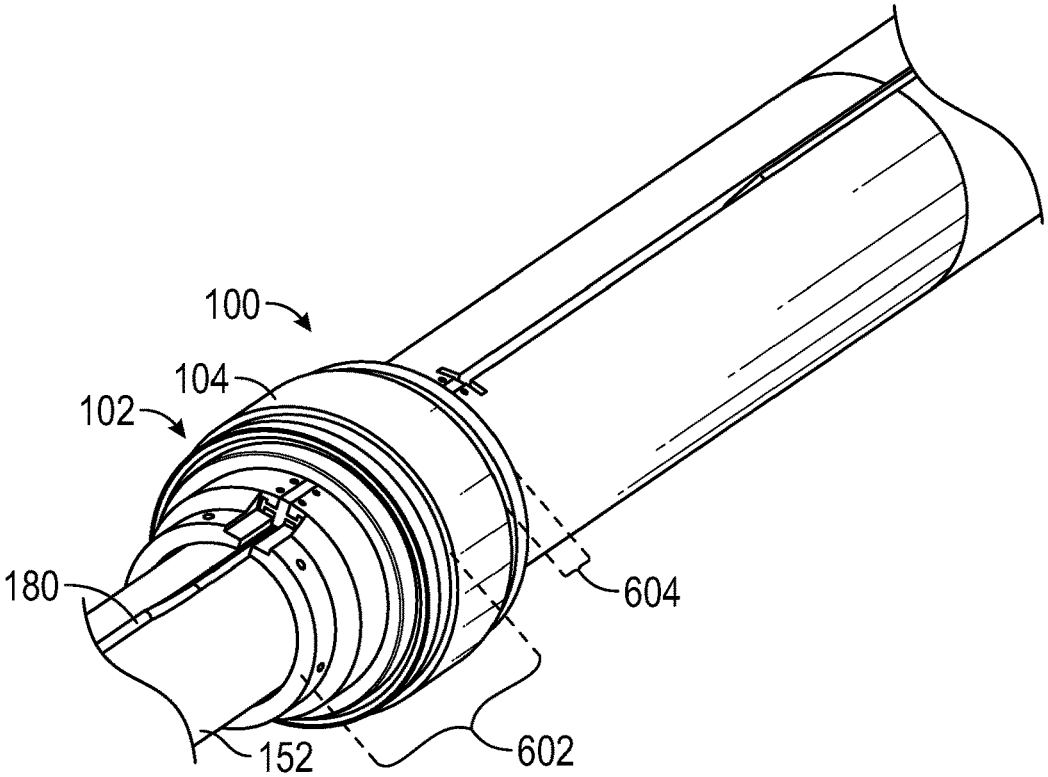
FIG. 7 is a schematic drawing depicting an isometric view of an embodiment of a mechanically-set packer system for use in a wellbore.

Referring to FIG. 7, an isometric view of an embodiment of a mechanically-set packer system 100 for use in a wellbore is depicted. In FIG. 7, the packer assembly 102 is shown as being set. In order to form a seal with the wellbore, the packer assembly 102 may be mechanically actuated to move the packing element 104 from an unset or unexpanded state (shown in FIG. 6) to a set or expanded state (shown in FIG. 7). In the set state, the first set of rings 602 and the second set of rings 604 may be compressed and may interact with each other to create an expansion force on the packing element 104. The compression may include weight-set compression, hydraulic-set compression, or hydrostatic-set compression. As a result of the compression, the packing element 104 may be expanded to form a seal with a wall of a wellbore. The packing element 104 may also form a seal with the mandrel 152 and the line 180 positioned between the mandrel 152 and the packing element 104.

Figure 8:
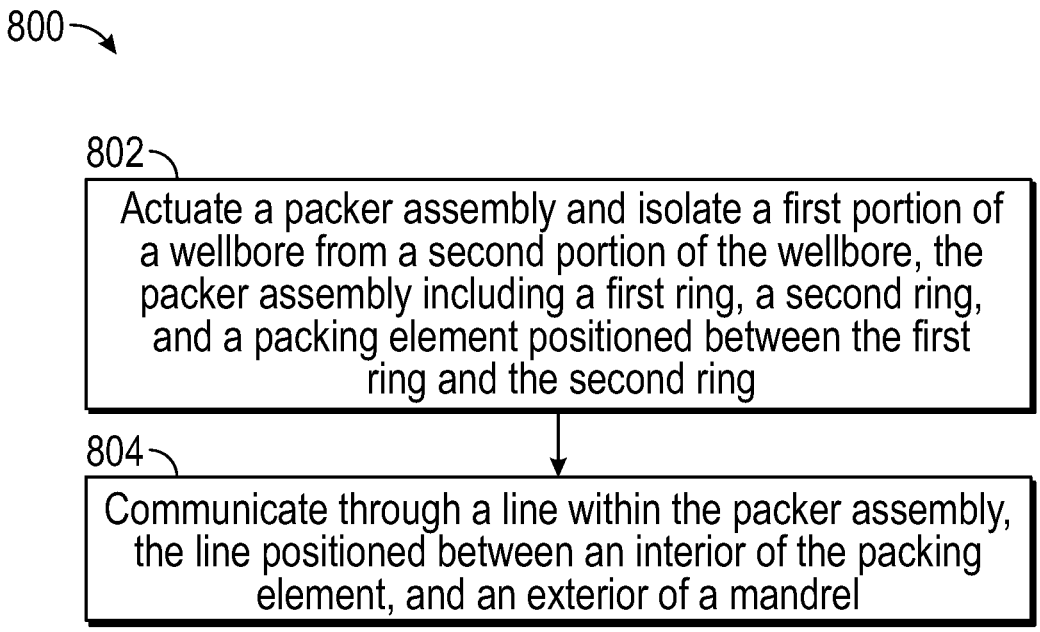
FIG. 8 is a flowchart of an embodiment of a method for setting a packer assembly.

Referring to FIG. 8, a flowchart of an embodiment of a method 800 for setting a packer assembly is depicted. The method 800 may include actuating a packer assembly that includes a first ring, a second ring, and a packing element positioned between the first ring and the second ring, at 802. Actuating the packer assembly may include mechanically setting the packer assembly within an open-hole wellbore such that the packing element forms a seal with the line, the mandrel, and a wall of the open-hole wellbore. For example, the packer assembly 102 may be set within a wellbore.

The method 800 may further include transmitting a signal through a line within an interior of the packer assembly, the line positioned between an interior of the packing element and an exterior of a mandrel. For example, a communication signal and/or control signal may be transmitted through the line 180.

An advantage of the method 800 is that by positioning the line between the mandrel and a packing element of the packing assembly, the line may be used to communicate with a tool downhole of the packer without having to splice the line at the point of the packer assembly. Other benefits and advantages may exist.

Although various embodiments have been shown and described, the present disclosure is not so limited and will be understood to include all such modifications and variations as would be apparent to one skilled in the art.

What is claimed is:

1. A mechanically-set packer system for use in a wellbore, the mechanically-set packer system comprising:

a packer assembly including:

a first ring and a second ring, wherein the first ring is a first inner groove ring and wherein the second ring is a second inner groove ring;

a packing element positioned between the first ring and the second ring;

a first outer grooved ring and a second outer grooved ring, wherein the first inner groove ring and the second inner groove ring are positioned between the first outer grooved ring and the second outer grooved ring;

a first keyed inner wedge ring and a second keyed inner wedge ring, wherein the first outer grooved ring and the second outer grooved ring are positioned between the first keyed inner wedge ring and the second keyed inner wedge ring;

a mandrel having an interior and an exterior, wherein the packer assembly is configured to slide onto the exterior of the mandrel;

a line configured to run between the exterior of the mandrel and an interior of the packing element; and wherein the first keyed inner wedge ring and the second keyed inner wedge ring each include a keyed opening that enable the packer assembly to slide off the mandrel.

2. The system of claim 1, wherein the packer assembly further includes a first wedge C-ring and a second wedge C-ring, wherein the first keyed inner wedge ring and the second keyed inner wedge ring are positioned between the first wedge C-ring and a second wedge C-ring.

3. The system of claim 1, wherein the packer assembly further includes a keyed gauge ring, wherein the keyed gauge ring includes a keyed opening that enables the packer assembly to slide off the mandrel.

4. The system of claim 1, further comprising a longitudinal recess in the exterior of the mandrel, the longitudinal recess configured to receive the line therein.

5. The system of claim 1, further comprising a cover positioned over at least a portion of the line positioned between the exterior of the mandrel and the interior of the packing element.

6. The system of claim 5, wherein the cover includes a metallic material, an elastomeric material, a thermoplastic material, or a combination thereof.

7. The system of claim 1, wherein the packer assembly is configured to be mechanically set within an open-hole wellbore.

8. The system of claim 1, wherein the packing element includes a cut to enable the line to be installed within the inner diameter of the packing element sub-assembly after the packing element sub-assembly is assembled.

9. The system of claim 1, wherein the line is a pneumatic line, an electrical line, or an optical line.

10. The system of claim 1, further comprising a housing having an exterior and an interior, the interior of the housing positioned on a portion of the exterior of the mandrel, wherein the line passes through a groove within the housing from the interior of the housing to the exterior of the housing.

11. The system of claim 1, wherein the mandrel includes a first end and a second end, and wherein the line includes no splices between the first and the second end.

12. The system of claim 1, wherein the packer assembly is assembled at a well site.

13. A method comprising:

positioning a line within a packer assembly through a cut completely through a packing element of the packer assembly, an interior surface of the packing element being positioned on an exterior of a mandrel;

actuating the packer assembly and isolating a first portion of the wellbore from a second portion of a wellbore, the packer assembly including a first ring, a second ring, and the packing element being positioned between the first ring and the second ring;

communicating through the line within the packer assembly, the line positioned between the interior surface of the packing element and the exterior of the mandrel.

14. The method of claim 13, wherein actuating the packer assembly includes mechanically setting the packer assembly within an open-hole wellbore, wherein setting the packing element forms a seal with the line, the mandrel, and a wall of the open-hole wellbore.

15. The method of claim 13, wherein actuating the packer assembly includes applying weight-set compression, hydraulic-set compression, or hydrostatic-set compression to the packing element.

16. A packing element sub-assembly system including:

a mandrel;

at least one wedge C-ring positioned on the mandrel;

at least one keyed wedge ring positioned on the mandrel;

at least one inner wedge ring key, the at least one inner wedge ring key configured to be inserted to a gap in the at least one keyed wedge ring;

a packing element having an interior and an exterior positioned on the mandrel, the at least one keyed wedge ring positioned between the at least one wedge C-ring and the packing element; and a feedline within the interior of the packing element, wherein the feedline is positioned between an exterior of the mandrel and the interior of the packing element.

17. The system of claim 16, further comprising:

at least one keyed gauge ring positioned on the mandrel, the at least one keyed gauge ring being positioned outside of the at least one wedge C-ring with respect to the packing element;

at least one gauge ring key, the at least one gauge ring key configured to be inserted into a gap in the at least one keyed gauge ring;

at least one outer grooved C-ring positioned on the mandrel; and at least one inner grooved C-ring positioned on the mandrel, the at least one inner grooved C-ring being positioned between the packing element and the at least one outer groove C-ring and the at least one outer grooved C-ring being positioned between the at least one inner grooved C-ring and the at least one keyed wedge ring.

* * * * *